United States Patent [19]

Gaskell et al.

[11] Patent Number: 4,591,100

[45] Date of Patent: May 27, 1986

[54] INJECTION NOZZLE

[75] Inventors: David J. Gaskell, Upper Stanstead; John W. Stevens, Sudbury, both of United Kingdom

[73] Assignee: Lucas Industries, Birmingham, England

[21] Appl. No.: 639,147

[22] Filed: Aug. 9, 1984

[30] Foreign Application Priority Data

Aug. 25, 1983 [GB] United Kingdom ..... 8322887

[51] Int. Cl.[4] ..... F02M 47/00

[52] U.S. Cl. ..... 239/533.3

[58] Field of Search ..... 239/533.2–533.12

[56] References Cited

U.S. PATENT DOCUMENTS

| | | | |
|---|---|---|---|
| 3,718,283 | 2/1973 | Fenne | 239/533.4 |
| 4,216,912 | 8/1980 | Kapse | 239/533.4 |
| 4,285,471 | 8/1981 | Eblin | 239/533.4 |
| 4,412,657 | 11/1983 | Moubray | 239/533.9 |

FOREIGN PATENT DOCUMENTS

| | | |
|---|---|---|
| 474978 | 3/1928 | Fed. Rep. of Germany . |
| 2555019 | 6/1977 | Fed. Rep. of Germany . |

*Primary Examiner*—Andres Kashnikow
*Assistant Examiner*—Kevin P. Weldon

[57] ABSTRACT

A fuel injection nozzle for supplying fuel to an internal combustion engine comprises an inwardly opening valve member which is urged by fuel under pressure against the action of a spring to allow fuel flow through an outlet opening. The valve member is surrounded by a sleeve member which is also subjected to the fuel pressure and engages the valve member to assist the initial movement thereof. The sleeve is slidable in a bore and the valve member in the sleeve. The working clearance between the wall of the bore and the sleeve and between the sleeve and the valve member are interconnected by radial bores or by making the sleeve from porous material such as sintered material.

4 Claims, 1 Drawing Figure

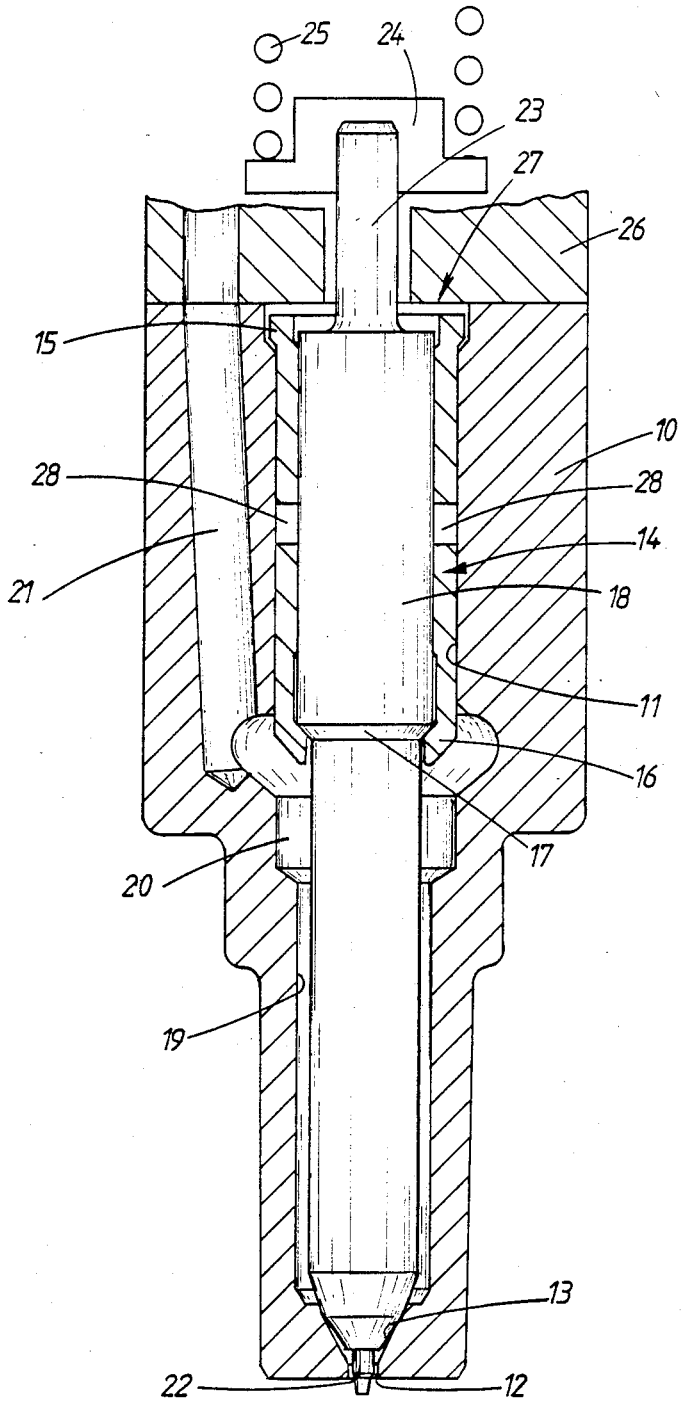
25
24
23
27
26
15
10
28
28
14
21
18
11
16
17
20
19
13
22
12

INJECTION NOZZLE

This invention relates to a fuel injection nozzle for supplying fuel to an internal combustion engine and of the kind comprising a body part in which is defined a bore which communicates at one end with an outlet opening extending to the exterior of the body part, a seating defined at said one end of the bore, a valve member movable in the bore, the valve member being shaped for co-operation with said seating, resilient means acting to urge the valve member into contact with said seating, a fuel inlet passage through which in use fuel under pressure can be supplied to act on a surface of the valve member to move the valve member away from the seating thereby to allow fuel flow through said outlet opening, an annular member surrounding the valve member, means on the annular member engageable with said valve member, said annular member being subjected to the fuel under pressure so as to generate a force which is applied to said valve member to assist the movement thereof away from the seating and means for limiting the movement of the annular member.

It is convenient to form the annular member as a sleeve slidable in the bore with the valve member being guided by the surface of the bore in the sleeve. The outer and inner surfaces of the sleeve member must have working clearance with the bore in the body and the valve member respectively and fuel at high pressure can flow into the working clearances. In theory the fuel pressures in the working clearances along the length of the sleeve should be the same but in practice this may not be the case due to slight differences in the working clearances. The differences in pressure can cause distortion of the sleeve which may therefore cause it to stick in the bore in the body or to bind on the valve member. The effect is to alter the operating characteristics of the nozzle.

The object of the present invention is to provide a fuel injection nozzle of the kind specified in a simple and convenient form.

According to the invention in a nozzle of the kind specified said annular member comprises a sleeve slidable in the bore in the body with the valve member being slidably mounted in the bore in the sleeve, the sleeve being provided with passage means whereby the fuel pressures in use in the working clearances between the inner and outer walls of the sleeve are substantially equal.

An example of a fuel injection nozzle in accordance with the invention will now be described with reference to the accompanying drawing which shows the nozzle in sectional side elevation.

Referring to the drawing the nozzle comprises a stepped body part 10 in which is defined a stepped bore 11 the narrower end of the bore communicates with an outlet opening 12 which extends to the exterior of the body and defined at this end of the bore is a seating 13. Axially movable within the wider portion of the bore is a sleeve 14 which at its end adjacent the other end of the bore 11 is provided with an enlarged portion 15 which limits the extent of movement of the sleeve into the bore, the bore being slightly enlarged to accommodate the enlarged portion. At its opposite end the sleeve is provided with an inwardly extending portion 16 which is shaped for engagement with a step 17 defined on a valve member 18 which is slidable within the bore in the sleeve.

The portion of the valve member which extends from the sleeve member in the direction of the seating 13 is of smaller diameter than the narrower portion of the bore to define an annular clearance 19 through which fuel can flow from a space 20 defined by the wider portion of the bore and lying beneath the sleeve 14. This space communicates with a fuel inlet passage 21 which in use, is connected to the outlet of a fuel injection pump. The end of the narrower portion of the valve member remote from the step 17 is shaped to co-operate with the seating 13 but in addition, it has a projection 22 which extends with clearance through the outlet opening 12. The projection 22 being known in the art as a "pintle". The pintle defines an annular clearance with the wall of the opening 12 and through which when the valve member is lifted from its seating as will be explained, fuel under pressure can flow.

The end of the valve member remote from the seating is provided with an extension 23 which mounts a spring abutment 24 for one end of a coiled compression spring 25. The nozzle body 10 is mounted in use at the end of a supporting holder 26 and the end surface 27 of the holder provides a stop surface to limit the extent of movement of the sleeve 14 and also a stop surface to limit the extent of movement of the valve member 18. It will be noted however that the movement of the valve member 18 from the closed position in which it is shown, is greater than the allowed movement of the sleeve.

In operation, when fuel under pressure is supplied to the fuel inlet passage 21 the fuel pressure acts upon the end of the sleeve and also the differential area of the valve member and a force is generated which acts to move the valve member against the action of the spring 25. When the force is sufficiently high the valve member will lift from its seating to permit fuel flow through the annular clearance between the pintle and the wall of the outlet opening. The movement of the valve member will continue until the end of the sleeve 14 engages the surface 27. Thereafter no further movement of the sleeve takes place and further movement of the valve member will only take place when there has been an increase in the fuel pressure. The movement of the valve member is also limited by the surface 27 and during the continued movement of the valve member the portion 16 will separate from the step 17. The valve member therefore has two stages of lift and this ensures that the pintle can properly control fuel flow through the outlet opening 12.

It will of course be appreciated that working clearances must be established between the wall of the bore 11 and the outer surface of the sleeve and between the outer surface of the valve member and the inner surface of the sleeve. Since the working clearances at one end are exposed to the fuel under pressure in the space 20, leakage of fuel will take place along the working clearances and this fuel will be conveyed to a drain. Providing the working clearances are of exactly the same size the pressure drop which occurs along the working clearance will be substantially the same that is to say there will be no pressure difference between the fuel in the working clearances along the axial length of the sleeve. If however the working clearances are not of the same radial dimension as indeed is likely to be the case in practice, the pressures will not be the same so that a pressure drop will exist between the inner and outer surfaces of the sleeve. Such pressure drop could cause distortion of the sleeve causing it to stick in the bore 11 so that it cannot properly assist the initial movement of the valve member or causing it to bind on the valve member which may impede the final movement of the valve member when the sleeve has been halted by the surface 27. In order to equalize the pressures in the working clearances, the sleeve can be provided with a plurality of radial apertures 28 which extend between the inner and outer surfaces of the sleeve. Only two such apertures are shown but more can be provided both about and along the length of the sleeve. It is also possible to provide the equivalent of the apertures by forming the sleeve from a sintered material having a suitable porosity such that fuel flow could occur between the working clearances to minimise any difference in pressure in the working clearances.

We claim:

1. A fuel injection nozzle for supplying fuel to an internal combustion engine comprising a body part, a stepped bore defined in the body part, said bore communicating at one end with an outlet opening extending to the exterior of the body part, a seating defined at said one end of the bore, a valve member movable in the bore, the valve member being shaped for co-operation with said seating, resilient means acting to urge the valve member into contact with said seating, a fuel inlet passage through which in use fuel under pressure can be supplied to act on a surface of the valve member to move the valve member away from the seating thereby to allow fuel flow through said outlet opening, an annular member surrounding the valve member, means on the annular member engageable with said valve member, said annular member being subjected to fuel under pressure so as to generate a force which is applied to said valve member to assist the movement thereof away from the seating and means for limiting the movement of the annular member, said annular member comprising a sleeve defining a further bore and being slidable in said bore in the body part, the valve member being slidably mounted in said further bore, the sleeve being provided with passage means whereby the fuel pressures in use in the working clearances between the inner wall of the sleeve and the valve member and the outer wall of the sleeve and the wall of said bore in the body part, are substantially equal.

2. A nozzle according to claim 1 in which said sleeve is formed from a porous sintered material.

3. A nozzle according to claim 1 in which said sleeve is provided with a plurality of radial apertures.

4. A nozzle according to claim 1 in which said means on the annular member comprises an inwardly extending portion at one end of the annular member, said inwardly extending portion being engageable with a step defined on the valve member, said annular member at its opposite end defining an enlarged portion which acts to limit the extent of movement of the annular member towards said one end of the bore.

* * * * *